US005255508A

United States Patent [19]

Davis

[11] Patent Number: 5,255,508

[45] Date of Patent: Oct. 26, 1993

[54] FUEL NOZZLE ASSEMBLY AND METHOD FOR MAKING THE ASSEMBLY

[75] Inventor: Franklin J. Davis, Glastonbury, Conn.

[73] Assignee: United Technologies Corporation, Hartford, Conn.

[21] Appl. No.: 786,619

[22] Filed: Nov. 1, 1991

[51] Int. Cl.[5] ..... F23R 3/30

[52] U.S. Cl. ..... 60/39.32; 60/740; 60/748

[58] Field of Search ..... 60/39.02, 737, 740, 60/748, 39.31, 756, 39.32; 239/403, 404, 424

[56] References Cited

U.S. PATENT DOCUMENTS 4,322,945 4/1982 Peterson et al. ..... 60/39.32
4,600,151 7/1986 Bradley ..... 239/404
4,815,664 3/1989 Tuthill et al. ..... 239/424
4,946,105 8/1990 Pane, Jr. et al. ..... 239/403
5,117,637 6/1992 Howell et al. ..... 60/740

FOREIGN PATENT DOCUMENTS 2073398 10/1981 United Kingdom ..... 60/740

*Primary Examiner*—Richard A. Bertsch
*Assistant Examiner*—Timothy S. Thorpe
*Attorney, Agent, or Firm*—Gene Fleischhauer

[57] ABSTRACT

A fuel nozzle assembly 32 for a gas turbine engine 10 is disclosed. Various construction details relating to a heat shield 92 are developed. In one embodiment, the heat shield is attached to only a radial surface 96 on the assembly and is free to grow axially from the radial surface of attachment.

13 Claims, 3 Drawing Sheets

FIG. 1
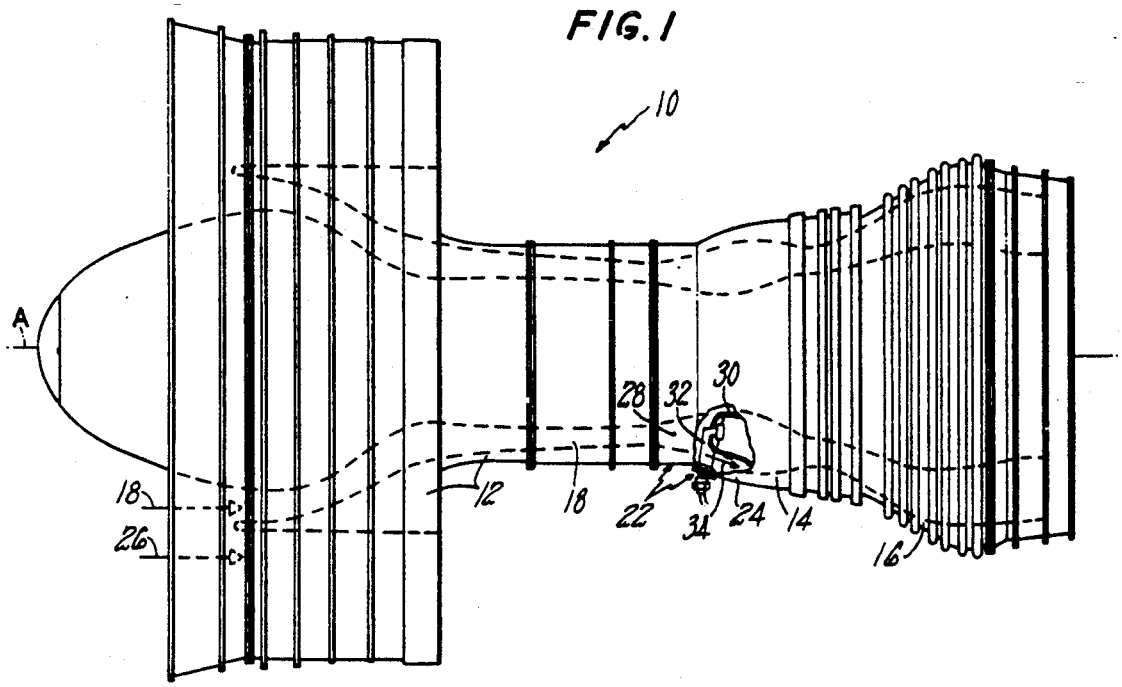
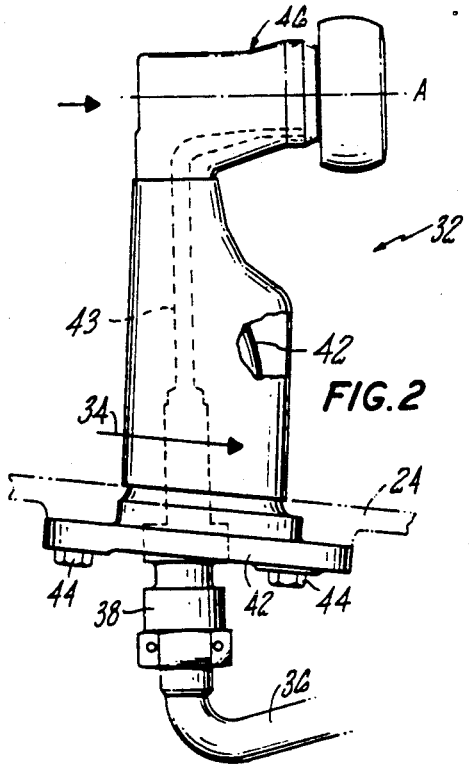
FIG. 2 fig.3
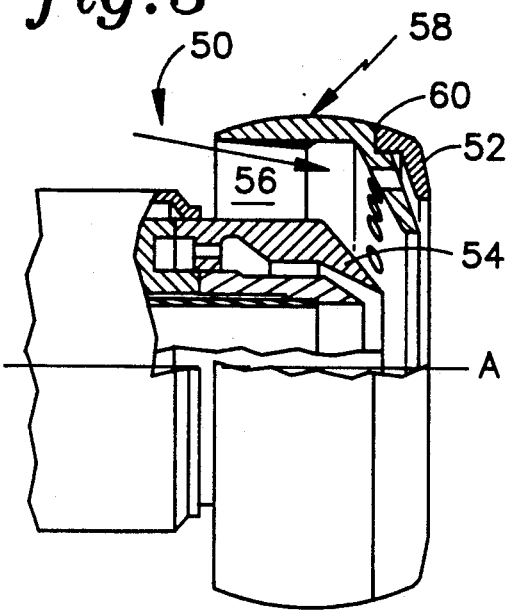
fig.4
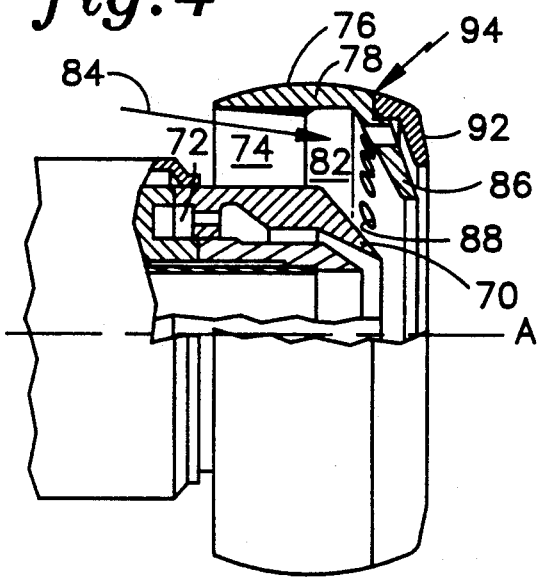
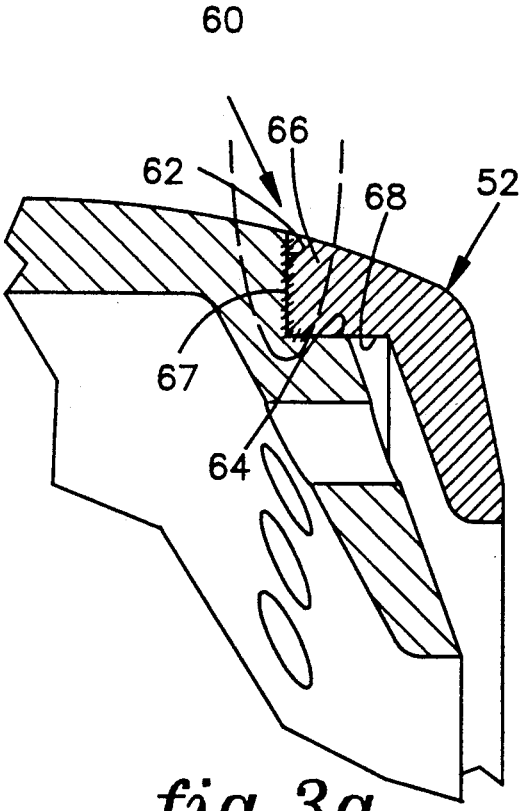
fig.3a
prior art
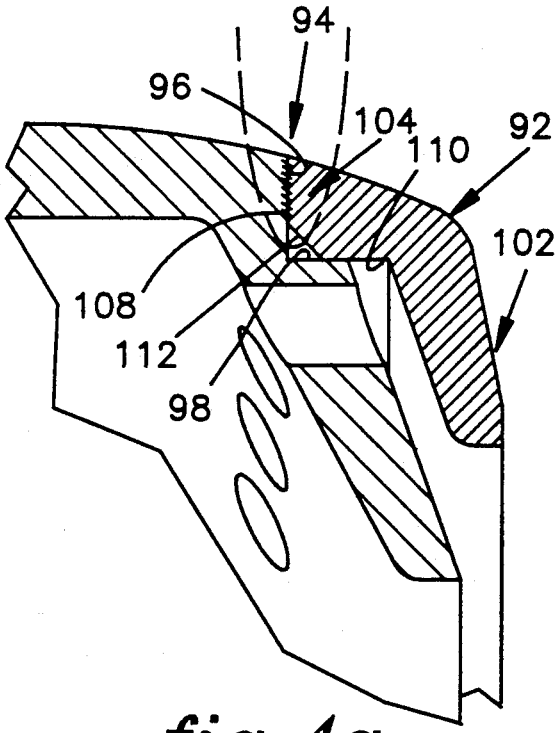
fig.4a

FUEL NOZZLE ASSEMBLY AND METHOD FOR MAKING THE ASSEMBLY

TECHNICAL FIELD

This invention relates to a fuel nozzle assembly for a combustion chamber of a gas turbine engine and more particularly to a heat shield for the fuel nozzle assembly and a method of installing the heat shield.

BACKGROUND OF THE INVENTION

A gas turbine engine, such as a gas turbine engine for an aircraft, includes a compression section, a combustion section and a turbine section. A flowpath for hot gases extends axially through the engine. The flowpath for hot gases is annular in shape. An engine case extends axially through the sections of the engine and circumferentially about the flowpath to bound the working medium flowpath.

As the working medium gases are flowed along the flowpath, the gases are compressed in the compression section causing the temperature and the pressure of the gases to rise. The hot, pressurized gases are burned with fuel in the combustion section to add energy to the gases. These gases are expanded through the turbine section to produce useful work and thrust.

The combustion section includes a combustion chamber and one or more fuel nozzles disposed in the combustion chamber for supplying fuel to the combustion chamber. The combustion chamber may be annular in shape and has an upstream end which is adapted by openings to receive a major portion of the hot, working medium gases discharged from the compression section. The gases are mixed with fuel (typically a combustible fluid such as JP4). The gases and fuel are ignited to produce gases whose temperature can exceed twenty-five hundred (2500) degrees Fahrenheit.

Each fuel nozzle assembly has a fuel nozzle or fuel nozzle head for discharging fuel into the combustion chamber. The fuel nozzle head includes a heat shield which extends circumferentially about the fuel nozzle head to shield the end of the fuel nozzle head from the hot, working medium gases in the combustion chamber.

One example of a fuel nozzle head 50 of the prior art having a heat shield 52 is shown in FIG. 3 and FIG. 3*a*. The fuel nozzle head includes a fuel nozzle tip 54 extending about an axis A. A plurality of swirl vanes 56 extend outwardly from the fuel nozzle tip. A swirler housing assembly is integrally joined to the swirl vanes. The swirler housing assembly engages the heat shield.

The swirler housing assembly 58 has a shoulder 60 which extends circumferentially about the assembly and which adapts the assembly to receive the heat shield. The shoulder has a first surface 62 which extends radially and a second surface 64 which extends axially. The heat shield has a base 66 which is adapted by corresponding surfaces 67, 68 to engage the swirler housing assembly.

As shown in FIG. 3*a*, the method of assembly includes focusing a beam of electrical current (electron beam weld) on the base of the heat shield and the swirler housing assembly at the adjacent surfaces 62, 64 to bond these surfaces together. The beam must penetrate and extend past the juncture of the surfaces in the heat shield to ensure that the weld is circumferentially continuous at its innermost dimension about the circumference of the assembly to avoid cracking. As a result, the base is attached to the first surface and the second surface of the swirler housing assembly.

This construction and method of assembly notwithstanding, scientists and engineers working under the direction of Applicant's assignee are seeking to improve fuel nozzle assemblies, and particularly, the heat shield and the method of installing the heat shield to the fuel nozzle assembly.

DISCLOSURE OF INVENTION

According to the present invention, a fuel nozzle assembly for a gas turbine engine has a shoulder facing downstream for receiving a heat shield and a heat shield which is secured at its base only along the radially extending surface of the shoulder and is free to grow thermally in the axial direction with respect to the axially extending surface of the shoulder.

In accordance with one embodiment of the present invention, an annular groove extends circumferentially about the circumference of the fuel nozzle assembly inwardly of the attachment of the heat shield to the shoulder to provide an insulating chamber therebetween.

In one detailed embodiment, the heat shield is spaced radially along its entire axial length (that is, from the attachment of the base at the radially extending surface on the shoulder to the downstream end of the heat shield) over most of the circumference of the end leaving an insulating and fabricating chamber therebetween.

According to the present invention, a method of making a fuel nozzle assembly includes the step of forming a shoulder in the fuel nozzle head and attaching the heat shield only to the radially extending surface of the shoulder.

In accordance with one detailed embodiment of the present invention for making a fuel nozzle assembly, the method includes passing an electron beam through the radially extending attachment surfaces for the heat shield and into an annular chamber radially inwardly of the surfaces such that the beam extends past the abutting contact between the surfaces but does not extend to the axially extending surface of the shoulder to avoid bonding the axially extending surfaces together.

A primary feature of the present invention is a fuel nozzle assembly having a fuel nozzle head. The fuel nozzle head has a shoulder for receiving a heat shield. Another feature is a heat shield which is adapted by a radially extending surface and an axially extending surface to engage the shoulder at the radially extending surface. In one detailed embodiment, the heat shield has a third surface which extends both radially and axially and is spaced from the shoulder leave an annular chamber therebetween. In one detailed embodiment, a plurality of cooling air holes extend axially through the adjacent structure in close proximity to the shoulder such that the holes are spaced radially from the shoulder by a distance which is smaller than the axial and radial length of the annular chamber at its largest dimensions.

A primary advantage of the present invention is a fuel nozzle assembly having increased fatigue life which results in part from permitting relative growth between the heat shield and the remainder of the assembly in the axial direction in response to differences in temperature between the heat shield and the adjacent structure under operative conditions. In one embodiment, an advantage is effective cooling of structures which results from reducing hole distortion and weld expulsion into cooling air holes in close proximity to the attachment of the heat shield by providing an annular chamber between the cooling air holes and the attachment of the heat shield to the assembly. In addition, during fabrication the annular chamber permits full weld penetration with no resulting cracks at the end of the weld and permits use of a less intense electron beam weld schedule which eliminates hole distortion and weld splatter in the cooling air holes. Still another advantage is the ease of fabrication and repair which results from retaining the heat shield along a single radial surface which results from using a single weld surface during fabrication and during weld removal in comparison to constructions which require welding and weld removal from two surfaces.

The foregoing features and advantages of the present invention will become more apparent in light of the following detailed description of the best mode of carrying out the invention and in the accompanying drawings.

BRIEF DESCRIPTION OF THE DRAWINGS

FIG. 1 is a side elevation view of a gas turbine engine showing a flowpath for working medium gases in phantom with a portion of the engine case broken away to show an annular combustion chamber and a fuel nozzle assembly.

FIG. 2 is an enlarged view of a portion of FIG. 1 showing a fuel nozzle assembly which includes a fuel nozzle support and a fuel nozzle head.

FIG. 3 and FIG. 3*a* are enlarged cross-sectional views of a portion of a fuel nozzle head of the prior art.

FIG. 4 and FIG. 4*a* are enlarged cross-sectional views of the fuel nozzle head of the present invention.

BEST MODE FOR CARRYING OUT THE INVENTION

Figure 5:
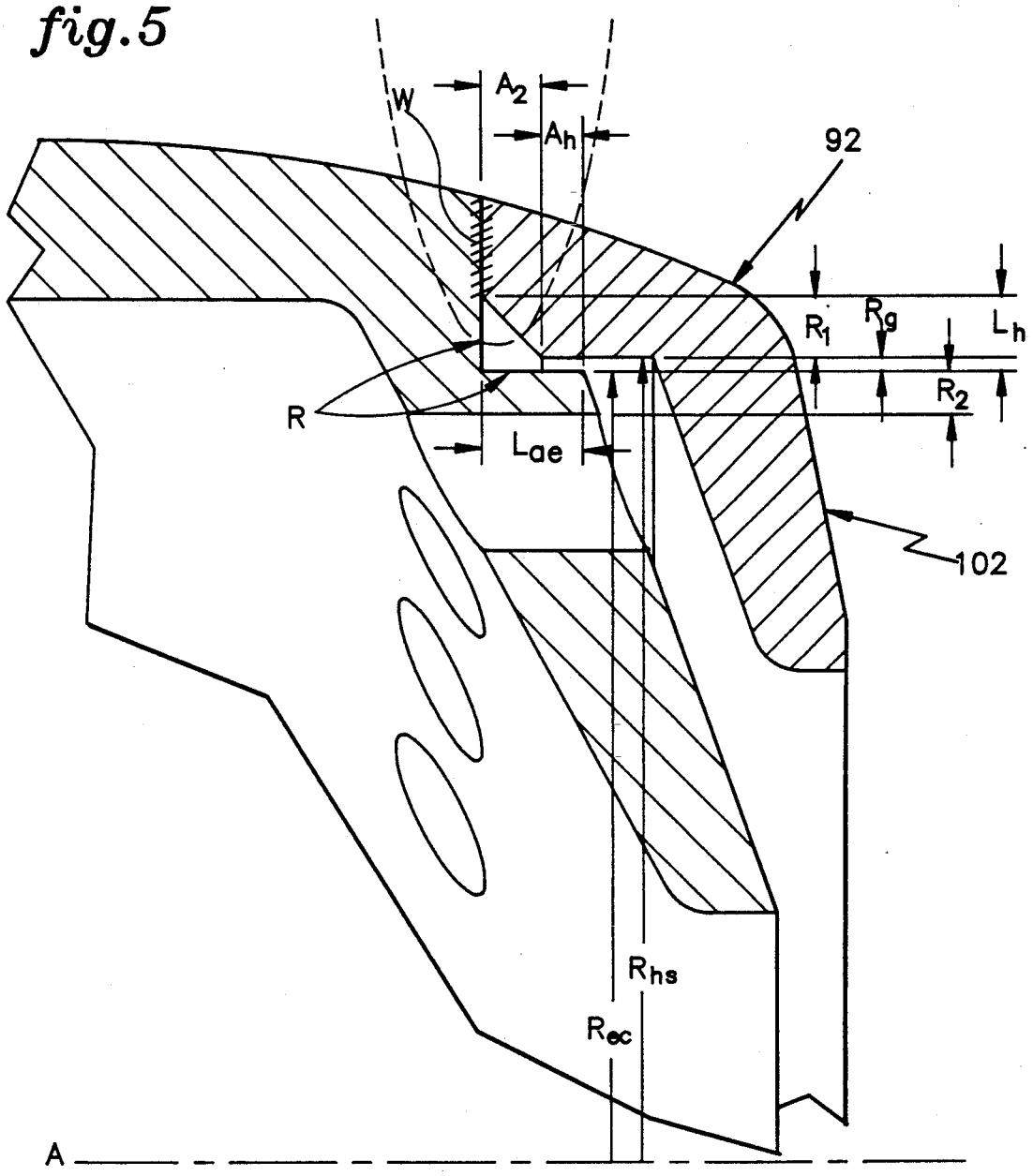
FIG. 5 is an enlarged view of the fuel nozzle head of FIG. 4*a* taken along a cross-sectional plane which is spaced circumferentially from the plane shown in FIG. 4*a*.

FIG. 1 is a side elevation view of an axial flow gas turbine engine 10 of the turbofan type. The engine has an axis $A_e$. A compression section 12, a combustion section 14 and a turbine section 16 are disposed circumferentially about the axis $A_e$.

An annular flowpath 18 for working medium gases extends circumferentially about the axis $A_e$ and rearwardly through the sections of the engine. The flowpath is shown in phantom. The engine includes a stator assembly 22 having a casing, such as an outer case 24. The outer case extends circumferentially about the flowpath and rearwardly through the engine to bound the working medium flowpath. An annular flowpath 26 for working medium gases, commonly called the secondary or bypass flow path, is radially outwardly of the primary flow path and extends rearwardly about the primary flow path.

The exit of the compression section 12 includes a diffuser region 28 which is immediately upstream of the combustion section 14. An annular combustion chamber 30 in the combustion section extends circumferentially about the axis of the engine downstream of the diffuser region. The combustion chamber is adapted by openings (not shown) to receive hot, pressurized gases from the diffuser region of the compression section.

A plurality of fuel nozzle assemblies, as represented by the single fuel nozzle assembly 32, extends radially inwardly across the working medium flowpath 18 to the annular combustion section. A portion of the working medium gases from the diffuser section are bypassed around the combustion section along a flowpath 34 for cooling air. The cooling air is flowed into the combustion chamber for cooling the combustion chamber through holes (not shown) and the remainder is flowed downstream to the turbine section along the cooling air flowpath to cool components of the turbine section.

FIG. 2 is an enlarged view of an engine case, as represented by the outer case 24, and the fuel nozzle assembly 32 shown in FIG. 1. A fuel line 36 is in flow communication with a source of fuel (not shown). The fuel line is attached to the fuel nozzle assembly.

The fuel nozzle assembly includes a fuel nozzle support 42 and has a first passage 43 for fuel in flow communication with the fuel line. The fuel nozzle support is adapted to engage the outer case and is attached by bolts 44 to the outer case. The fuel nozzle support extends inwardly from the case in a generally radial direction. The fuel nozzle assembly includes a fuel nozzle head 46 (commonly referred to as a fuel nozzle) which is attached to the fuel nozzle support and extends in a generally axial direction.

FIG. 3 and FIG. 3*a* are views of the prior art construction discussed earlier in the "Background of the Invention" section of this application.

FIG. 4 is an enlarged side elevation view of the fuel nozzle head 46 shown in FIG. 2 with a portion of the head broken away and sectioned for clarity. As shown in FIG. 4, the fuel nozzle head includes a fuel nozzle tip 70 extending circumferentially about the axis A of the fuel nozzle assembly. The fuel nozzle tip has a second passage 72 for fuel extending through the tip which is in flow communication with the first passage for fuel. A plurality of swirl vanes, as represented by the swirl vane 74, extend outwardly from the fuel nozzle tip.

A swirler housing assembly 76 extends circumferentially about the fuel nozzle tip. The swirler housing assembly includes a swirler housing 78 integral with the swirl vanes. The swirler housing extends circumferentially about the fuel nozzle tip and is spaced radially from the tip leaving an annular passage 82 for a flow path 84 for cooling air extending axially therebetween. An end cap 86 downstream of the swirl vanes extends circumferentially about and inwardly from the swirler housing. The end cap extends across a portion of the annular passage to direct the cooling air toward the axis A. The end cap has a plurality of circumferentially spaced cooling holes 88 in flow communication with the annular passage. The cooling holes adapt the end cap to discharge cooling air toward downstream structure.

The downstream structure of the fuel nozzle assembly includes a heat shield 92 extending circumferentially about the axis A. The heat shield is attached to the remaining structure of the fuel nozzle assembly. The remaining structure is adapted by a shoulder 94 to receive the heat shield and is attached as described with reference to FIG. 4*a*.

FIG. 4*a* is an enlarged view of a portion of the swirler housing assembly and fuel nozzle tip shown in FIG. 4. The shoulder 94 on the swirler housing assembly 76 has a first surface 96 which extends radially and a second surface 98 which extends axially. The second surface intersects the first surface at an intersection region R as measured on the respective surfaces. The heat shield has a downstream end and an upstream end. The upstream end has a base 106 having a first surface 108 which extends radially and faces in the axial direction. The first surface is integrally joined to the first surface on the swirler housing assembly, such as by welding, bonding or like processes. The heat shield has a second surface 110 which extends axially and faces inwardly towards the axis A. As shown at the section taken in FIG. 4*a*, the second surface 110 is in abutting contact with the second surface 98 which extends axially on the end cap. In embodiments having a second surface of the heat shield which has a larger radius $R_{hs}$ than the radius $R_{ec}$ of the second surface of the end cap, the abutting contact will occur over a limited portion of a circumferential extent of the heat shield and will result in the heat shield being spaced over the remainder of the circumference by a radial gap from the end cap which provides a passage for cooling air. Other embodiments might provide abutting, slidable, contact about the entire circumference of the heat shield between the heat shield and the end cap.

The heat shield 92 has a third surface 112 which intersects the first surface 108 and the second surface 110 at included angles x and y. These angles are greater than ninety (90) degrees. The third surface extends between the first surface and the second surface of the heat shield. The third surface is spaced from the swirler housing assembly over at least a portion of the first surface and the second surface of the swirler housing assembly leaving an annular insulating chamber therebetween. The annular insulating chamber extends circumferentially between the heat shield and the end cap and is in flow communication with the cooling air flowpath.

FIG. 5 is a sectional view corresponding to the sectional view shown in FIG. 4*a* after rotation of the sectioning plane about the axis A. As shown, a radial gap $R_g$ extends circumferentially between the second surface 110 of the heat shield 92 and the second surface 98 of the end cap 86. The intersection region R extends at least a distance $R_1$ on the first surface of the shoulder (that is, the radial distance between the axial surface and the radial surface on the heat shield) and at least a distance $A_2$ on the second surface of the shoulder. These also are distances which are radially and axially overlapped by the third surface 112 of the heat shield. And, because the third surface is spaced away from the end cap 86 in a radial direction and is spaced away from the end cap in the axial direction, this construction provides the annular insulating and fabrication chamber 114 with distances as measured on the end cap which are at least $R_1$ and $A_2$.

The second surface 98 on the shoulder on the end cap 86 has an axial length $L_{ae}$. The second surface on the heat shield is spaced axially from the first surface on the heat shield by at least the distance $A_2$ which is greater than or equal to one-half the distance $L_{se}$ to axially space the second surface of the heat shield away from the first surface of the shoulder. This decreases the area available for conductive heat transfer from the downstream end 102 of the heat shield to the cooling air holes 88 during operative conditions and during fabrication. This is important because at least one of the cooling air holes is spaced from the second surface by a distance $R_2$ which is less than the distance $R_1$ and which is less than the distance $A_2$. The decrease in heat transfer area increases the resistance to heat transfer and shifts severe temperature gradients in the end cap which might cause distortion of the cooling air holes away from the cooling air holes. Finally, the second surface on the heat shield overlaps the second surface on the shoulder on the end cap by a distance $A_h$ which is also less than one-half the distance $L_{ae}$, decreasing heat transfer area in instances where the heat shield abuts the end cap.

FIG. 4*a* and FIG. 5 also serve to illustrate the improved method of forming a fuel nozzle assembly having the improved heat shield. The method includes the steps of forming a circumferentially extending shoulder on the swirler housing assembly with the shoulder having a first surface which extends radially and faces in a downstream direction and a second surface which extends axially and intersects the first surface at the intersection region R.

The method includes the step of disposing the heat shield about the shoulder with the first surface 08 of the heat shield 92 in abutting contact with the first surface 96 of the shoulder and the second surface 110 of the heat shield either abutting the second surface 98 of the shoulder (FIG. 4*a*) or spaced radially from the second surface of the shoulder as shown in FIG. 5.

The method includes the step of attaching the heat shield to the swirler housing assembly at the first surface of the end cap, such as by using an electron beam welding process by passing a beam of electrical current through the heat shield and the swirler housing assembly. The beam is focused such that the beam intersects the annular chamber extending circumferentially about the swirler housing assembly. This has several advantages.

First, the operator can focus the beam any place in the intersection region R and still provide for full weld penetration in the welding region between the first surface of the swirler housing assembly and the first surface of the heat shield. This causes a weld to form along the weld line W. Secondly, the annular chamber reduces the mass of material in the path of the beam and allows the use of a less intense electron beam weld schedule as compared to the FIG. 3 structure which has material in this region. This aids in avoiding any distortion that might occur in the closely spaced cooling hole and any weld splatter in the holes that would interfere with acceptable cooling flow through the holes. Thirdly, the heat of welding is transferred through a much reduced area, increasing the resistance to the flow of heat into the cooling hole region and further reducing the possibility of thermal distress during fabrication.

Finally, the method of fabrication and design provides an advantage during reconstruction of the fuel nozzle after the heat shield has exceeded its expected life. The heat shield may be machined away with a simple single point tool, cutting radially inwardly along the first surface until the heat shield is freed from the first surface 96. The entire length $R_1$ provides a tolerance to the cutting operation which decreases the amount of time needed to remove the heat shield by providing for a rapid set-up and completion of the machining task. In the prior art construction, the second surface 98 on the end cap must be carefully machined to tight tolerances to ensure that reinstallation of the tip cap can be accomplished in a satisfactory manner.

During operation of the gas turbine engine, the hot, working medium gases transfer heat by convection and radiation to the end of the heat shield. The heat is transferred via the heat shield into the swirler housing assembly and thence into the end cap. As can be seen, the reduced heat transfer area at the second surface and in the end cap increases the resistance to the transfer of heat decreasing thermal stress in the end cap which is cooled by the cooling air flowing over and through the cooling air holes in the end cap. Increased durability and decreased thermal distortion result in comparison with constructions which provide for increased heat transfer.

Although the invention has been shown and described with respect to detailed embodiments thereof, it should be understood by those skilled in the art that various changes in form and detail thereof may be made without departing from the spirit and scope of the claimed invention.

I claim:

1. In a fuel nozzle assembly of the type used in a gas turbine engine, the fuel nozzle assembly having a tip which is axially oriented, having a swirler housing assembly spaced radially from the tip leaving a passage for cooling air therebetween and having a plurality of swirl vanes which extend from the tip to the swirler housing assembly and which are integral with the swirler housing assembly, the swirler housing assembly including a shoulder having a radially extending and an axially extending surface which is adapted to receive a heat shield, the improvement which comprises:

a heat shield which is spaced radially over at least a portion of its axial length from the swirler housing assembly, which shields a portion of the swirler housing assembly and which is secured at its base only along the radially extending surface of the shoulder and is free to flow thermally in the axial direction with respect to the axially extending surface of the shoulder.

2. The fuel nozzle assembly of claim 1, wherein an annular groove extends circumferentially about the circumference of the fuel nozzle assembly inwardly of the attachment of the heat shield to the shoulder to provide an insulating chamber therebetween.

3. The fuel nozzle assembly of claim 2, wherein the swirler housing assembly has an end cap, the heat shield has a base attached to the first surface of the shoulder and the heat shield is spaced radially along its entire axial length over at least half of the circumference of the end cap leaving an insulating chamber therebetween.

4. A fuel nozzle assembly for a gas turbine engine having a flow path for working medium gases and a case which extends circumferentially about the flow path, which comprises:

a. a fuel nozzle support extending inwardly from the case which is positioned by the case and which has a first passage for fuel extending therethrough;

b. a fuel nozzle tip extending circumferentially about an axis A which is positioned by the support, the fuel nozzle tip having a second passage for fuel extending therethrough which is in flow communication with the first passage for fuel;

c. a plurality of swirl vanes extending outwardly from the fuel nozzle tip;

d. a swirler housing assembly having a shoulder which extends circumferentially about the assembly, the shoulder having a first surface which extends radially and a second surface which extends axially, the second surface intersecting the first surface at an intersection region R, the intersection region extending at least a distance $R_1$ on the first surface and a distance $A_2$ on the second surface, the swirler housing assembly further including a swirler housing integral with the swirl vanes which extends circumferentially about the fuel nozzle tip and is spaced radially from the tip leaving an annular passage for cooling air extending axially therebetween; and an end cap downstream of the swirl vanes which extends circumferentially about and inwardly from the swirler housing across a portion of the annular passage for directing the working medium gases toward the axis A, the end cap having a plurality of circumferentially spaced cooling holes in flow communication with the annular passage, at least one of the holes being spaced from the second surface by a distance $R_3$ which is less than the distance $R_1$ and $A_2$;

e. a heat shield extending circumferentially about the axis A and spaced from the first and second surfaces in the intersection region such that the shield does not abut the second surface in the extension region leaving an insulating gap therebetween, the heat shield being integrally joined to the first surface for a continuous length outside the intersection region and abuttingly engaging the second surface in the axial direction for a continuous length outside the intersection region; wherein the heat shield is axially movable with respect to the second surface under operative conditions to accommodate differences in thermal growth between the heat shield and the adjacent structure under operative conditions of the engine.

5. The fuel nozzle assembly for a gas turbine engine as set forth in claim 4, wherein the second surface has on the end cap has an axial length $L_{ae}$, the second surface of the heat shield is spaced axially from the first surface on the heat shield by a distance $A_2$ which is greater than or equal to one-half the distance $L_{se}$ and wherein the second surface on the heat shield overlaps the second surface on the end cap by a distance $A_h$ which is less than one-half the distance $L_{ae}$.

6. The fuel nozzle assembly for a gas turbine engine as set forth in claim 5, wherein the second surface of the end cap has a radius $R_{ec}$ about axis A and the second surface of the heat shield has a radius $R_{hs}$ about the axis A which is larger than the radius $R_{ec}$ of the end cap, the heat shield being spaced radially by a gap $R_g$ at least over half the circumference of the heat shield from the end cap.

7. The fuel nozzle assembly for a gas turbine engine as set forth in claim 6, wherein the heat shield abuttingly contacts the second surface of the end cap over a portion of the circumference of the end cap.

8. In a method of forming a fuel nozzle assembly for a gas turbine engine, the fuel nozzle assembly having a fuel nozzle tip extending circumferentially about an axis A and a swirler housing which is supported by the fuel nozzle tip, the swirler housing assembly being spaced radially from the fuel nozzle tip leaving a passage for cooling air therebetween, the swirler housing assembly including a swirler housing, an end cap which extends inwardly from the swirler housing, and a heat shield which is attached to the swirler housing assembly, the improvement which comprises:

forming a circumferentially extending shoulder in the swirler housing assembly, the shoulder having a first surface which extends radially and faces in a downstream direction and a second surface which extends axially and intersects the first surface at an intersection region, the intersection region extending at least a distance $R_1$ on the first surface and a distance $A_2$ on the second surface;

forming a heat shield which extends circumferentially about an axis, the heat shield having a first surface which extends radially and faces in the axial direction, a second surface which extends axially and faces inwardly toward the axis, and a third surface which extends from the first surface to the second surface, the third surface intersecting the first surface and second surface at included angles which are greater than ninety degrees, the third surface extending between the first surface and the second surface of the swirler housing assembly and being spaced therefrom over at least a portion of the first surface and the second surface leaving an insulating chamber therebetween;

attaching the heat shield to the swirler housing assembly at the first surface of the end cap and the first surface of the swirler housing assembly outwardly of the second surface of the swirler housing assembly such that the second surface of the heat shield is free to move in the axial direction with respect to the second surface of the swirler housing assembly.

9. The method of forming a fuel nozzle assembly as set forth in claim 8, wherein the step of attaching the heat shield to the swirler housing includes the step of passing an electron beam through the first surface and the second surface such as the focus beam of an electrical current does not extend to the second surface of the end cap, the electron beam extending past the juncture of the first surface of the swirler housing assembly and the first surface of the heat shield to the third surface of the heat shield and intersects in the annular chamber between the heat shield and the swirler housing assembly.

10. The method of forming a fuel nozzle assembly of claim 8 having a circumferentially extending heat shield which overlaps the end cap and is spaced axially from the end cap over a portion of the end cap, wherein the step of forming a shoulder on the swirler housing assembly includes the step of removing an existing heat shield from the swirler housing assembly by machining the first surface and the second surface of the swirler housing assembly to remove an existing heat shield from the swirler housing assembly which is joined to both the first surface and the second surface.

11. The method of forming a fuel nozzle assembly as set forth in claim 8 having a circumferentially extending heat shield which overlaps the end cap and is spaced axially from the end cap over a portion of the end cap, wherein the step of forming a shoulder on the swirler housing assembly includes the step of removing an existing heat shield from the swirler housing assembly by machining only the first surface and not the second surface to remove an existing heat shield from the swirler housing assembly which is joined only to the first surface of the swirler housing assembly and is free of the second surface of the swirler housing assembly.

12. The method of forming a fuel nozzle assembly as set forth in claim 9, wherein the second surface of the heat shield has a larger diameter than the second surface of the end cap and wherein the second surface of the heat shield is spaced radially from the second surface of the end cap over at least more than half the circumferential distance of the heat shield leaving a radial gap therebetween.

13. The method of forming a fuel nozzle assembly as set forth in claim 9, wherein the second surface of the heat shield has a larger diameter than the second surface of the end cap and wherein the second surface of the heat shield is in abutting contact with the end cap.

* * * * *